US009715974B2

(12) United States Patent
Sikiric et al.

(10) Patent No.: US 9,715,974 B2
(45) Date of Patent: Jul. 25, 2017

(54) MULTIPLE STATE SWITCH ASSEMBLY

(71) Applicant: Scanreco AB, Stockholm (SE)

(72) Inventors: Vedran Sikiric, Stockholm (SE); Jonas Lorander, Årsta (SE); Axel Svensson, Bandhagen (SE); Carl Moberg, Saltsjö-Boo (SE); Kaj Johansson, Stockholm (SE); Daniel Bodin, Rönninge (SE); Zoltan Palankai, Stockholm (SE)

(73) Assignee: SCANRECO AB, Stockholm (SE)

( * ) Notice: Subject to any disclaimer, the term of this patent is extended or adjusted under 35 U.S.C. 154(b) by 0 days.

(21) Appl. No.: 15/173,148

(22) Filed: Jun. 3, 2016

(65) Prior Publication Data

US 2017/0011868 A1 Jan. 12, 2017

(30) Foreign Application Priority Data

Jul. 8, 2015 (SE) ..... 1550997

(51) Int. Cl.

| | |
|---|---|
| ***H01H 13/64*** | (2006.01) |
| ***H01H 13/48*** | (2006.01) |
| ***H01H 13/66*** | (2006.01) |
| ***H01H 13/50*** | (2006.01) |
| ***H01H 13/06*** | (2006.01) |

(52) U.S. Cl.

CPC ..... *H01H 13/48* (2013.01); *H01H 13/06* (2013.01); *H01H 13/503* (2013.01); *H01H 13/64* (2013.01); *H01H 13/66* (2013.01); *H01H 2215/036* (2013.01); *H01H 2225/002* (2013.01)

(58) Field of Classification Search

CPC ..... H01H 13/48; H01H 13/64; H01H 13/66; H01H 5/30; H01H 2203/038; H01H 2215/004; H01H 2227/026; H01H 13/503

USPC ..... 200/406, 513, 517

See application file for complete search history.

(56) References Cited

U.S. PATENT DOCUMENTS

| | | | | |
|---|---|---|---|---|
| 3,971,902 | A | 7/1976 | Wulf et al. | |
| 4,659,881 | A | 4/1987 | Dowe | |
| 6,492,602 | B2 * | 12/2002 | Asai | H01H 13/14 200/406 |
| 7,687,734 | B2 * | 3/2010 | Weber | H01H 13/7065 200/406 |

(Continued)

FOREIGN PATENT DOCUMENTS

| | | | |
|---|---|---|---|
| DE | 20 2009 008 492 | U1 | 11/2010 |
| EP | 0 920 040 | A2 | 6/1999 |
| FR | 2 496 330 | A1 | 6/1982 |

*Primary Examiner* — Felix O Figueroa

(74) *Attorney, Agent, or Firm* — Birch, Stewart, Kolasch & Birch, LLP

(57) ABSTRACT

An electrical multiple stage switch assembly includes an assembly casing, a first component carrier, and at least one multiple stage switch including a first disc contact, at least one second disc contact, and an actuator. The first and second disc contacts are positioned with their centers substantially aligned, and the first and second disc contact are adapted to flex into an electrical connection when the actuator is pressed and to flex back into a non-electrical connection when the actuator is released. A controlling member includes a controlling part for each switch, and the controlling part includes a spacing member adapted to limit the smallest possible distance between adjacent component carriers.

16 Claims, 2 Drawing Sheets

(56) References Cited

U.S. PATENT DOCUMENTS

| | | | | |
|---|---|---|---|---|
| 8,698,016 | B2 * | 4/2014 | Walden | G06F 1/1662<br>200/5 A |
| 2008/0296141 | A1 | 12/2008 | Ogatsu et al. | |
| 2010/0224473 | A1 * | 9/2010 | Jeffery | H01H 13/48<br>200/512 |

* cited by examiner

MULTIPLE STATE SWITCH ASSEMBLY

TECHNICAL FIELD

The present invention relates to an electrical multiple stage switch assembly comprising an assembly casing, a first component carrier, and at least one switch, each multiple stage switch comprising a first disc contact, a second disc contact, and an actuator means, where respective disc contact is a convex disc contact. The first and second disc contact are positioned with their centers substantially aligned and respective actuator means is positioned in the assembly casing and adapted to compress the first and second disc contact. The first and second disc contact are adapted to flex into an electrical connection when the actuator means is pressed and to flex back into a non-electrical connection when the actuator means is released. The first disc contact is positioned on the first component carrier in a fixed electrically conductible manner.

The inventive multiple stage switch assembly can be used for remote control assemblies in both wired and wireless control applications for the control of machinery in different industrial applications, such as for the control of cranes.

PRIOR ART

Two stage switch assemblies are previously known where the assembly carries a number of two stage switches.

It is a constant requirement that switches be made more compact, requiring a minimum of space in an apparatus and yet be simple and reliable. It is another requirement that the switches be sealed in order to be applicable for installation on boards where fluid techniques such wave soldering are used. If the switch is not sealed, internal corrosion of the contacts due to contaminants would occur in the switch.

For certain applications, the operator expects to feel a switching action such as when going from one switch function to another. In the case of switches having internal contacts implemented with convex discs or domes positioned one above the other in a spaced relationship having their respective centers substantially in alignment. A flex or snap-action occurs when an operator pushes down on a push button which applies a force to the center of the domes. The operator can sense the snapping movement of the center portion of a first dome and then the snapping movement of the center portion of a second dome positioned under the first dome. This sensation is commonly known as "tactile feedback".

The flexing of the dome causes an electrical connection to occur first between the upper dome and the lower done, and then with further pressure on the push button, the lower dome makes electrical connection with a terminal in the base of the switch assembly. Thus, such a switch has a normally open position and two other positions for making electrical connection.

Such a switch assembly has to be assembled with low cost parts and low cost efficient means in order to be viable in the market place. Securing the lower dome may provide wider applicability of the switch.

Publication U.S. Pat. No. 4,659,881 discloses an electrical switch assembly with a pair of conducting resilient domes which snap inwardly to produce corresponding switching functions when downward pressure is applied at their respective centers and snap outwardly to produce opposite switching functions when the applied pressure is removed. The pair of domes are supported one within the other in spaced relation with their respective centers substantially in alignment. Pressure applying means, such as a push button, is mounted for movement in line with the aligned centers of the outer and inner domes to a first predetermined position to snap the outer dome inwardly and to a second predetermined position to snap the inner dome inwardly. The successive snapping actions of the two domes to produce corresponding switching functions provide respective stages of tactile feedback through the push button to the operator.

Publication EP 0 920 040 B1 discloses push button sealed, dual action, tactile feedback, electrical switch assembly of the type wherein an operator senses tactile feedback from switch contacts flexing when pressure is applied to the switch assembly. It comprises a first disc contact having a plurality of tabs extending therefrom, a second disc contact having a plurality of tabs extending therefrom, the first disc contact positioned above the second disc in a spaced apart relationship having their centers substantially aligned. Actuator means positioned above the first disc contact and adjacent thereto for moving a first predetermined distance causing the first disc contact to flex and be in electrical contact with the second disc contact and moving a second predetermined distance causing the second disc contact to flex and be in electrical contact with a base contact. Respective stages of the tactile feedback are provided by the flexing of the first disc contact and the second disc contact in response to movement of the applied pressure to the first predetermined distance and the second predetermined distance. The first disc contact and the second disc contact return to their original non-flex state when the applied pressure is removed.

With the purpose of securing the contacts to a base of the switch assembly EP 0 920 040 B1 teaches that the base means comprises a first plurality of multi-sided bins for positioning the tabs of the first disc contact in a first plane, and the base means comprises a second plurality of multi-sided bins for positioning the tabs of the second disc contact, the second plurality of multi-sided bins being positioned approximately forty-five degrees from the first plurality of the multi-sided bins and in a second plane above the first plane.

SUMMARY OF THE PRESENT INVENTION

Problems

It is a technical problem to provide an improved, low cost, small, sealed, tactile feedback, push button multiple state switch assembly.

It is also a technical problem to provide a switch assembly where the push buttons can be positioned close to each other, thus providing the possibility to increase the number of push buttons without having to increase the size of the switch assembly.

It is a technical problem to provide mechanical stability in a two stage switch without wobbling or instability between the stacked disc contacts, and it is a further technical problem to provide a multiple stage switch assembly, where there are more than two disc contacts stacked on each other, with a maintained mechanical stability between the stacked disc contacts.

Solution

With the purpose of solving one or several of the above problems, and on the basis of prior art such as it has been shown above and the indicated technical field, the present invention teaches that that each multiple stage switch comprise at least one second disc contact, meaning that it is possible to stack several disc contacts in one switch and thus achieving a true multiple stage switch with one stage for each disc contact.

The switch assembly comprises one second component carrier for each second disc contact, to which each second disc contact is connected, and at least one controlling member.

It is proposed that each second component carrier is electrically connected to the first component carrier thereby connecting each second disc contact to the first component carrier.

In order to enable each second disc contact to follow the movement of the actuator means in the compression of the first disc contact or another second disc contact it is proposed that each second disc contact is connected respective second component carrier in a flexible, yet electrically conductible, manner.

Each controlling member comprises a controlling part for each switch, and a controlling member is positioned between the component carriers in a way so that each disc contact is facing a controlling part. The controlling part is connected to the controlling member in a flexible manner in order to enable the controlling part to follow the movement of respective disc contact as the contacts are pressed by the actuator means and as they flex back when released. It is proposed that the controlling member is made out of a flexible material in order to provide the flexible connection of the controlling part, which has to be a material that can endure the required number of actuations with a maintained mechanical flexibility. An example of a flexible and endurable material that can be used is Polyoxymethylene (POM).

With the purpose of protecting respective disc contact from destructive compression when pressed by the actuator means it is proposed that the controlling part comprises a spacing member adapted to limit the smallest possible distance between adjacent component carriers, thus limiting the highest possible compression from the actuator means.

It is also proposed that the controlling part comprises a counter protrusion facing the disc contact, where the counter protrusion is recessed at the center of the disc for concentrating the applied pressure on the disc contact with its convex shape.

Where adjacent disc contacts are facing each other it is proposed that the controlling part comprises a first counter protrusion facing one disc contact and a second counter protrusion facing the other disc contact, and that respective counter protrusion is recessed at the center of the disc for concentrating the applied pressure on the respective disc contact with its convex shape.

It is proposed that each second disc contact is connected to respective second component carrier by means of a connector that will allow the required movement of the second disc contact, such as by means of flexible circuit carrier. It is important that the flexible circuit carrier allows required movement of the second disc contact and can endure the required number of actuations with a maintained electrical conductivity, mechanical flexibility and mechanical strength. An example of a material for a flexible circuit carrier that is PI SF305C 1025.

The whole second component carrier can be manufactured by a flexible circuit carrier, however, it is also possible that only the connector is made out of the flexible material, in which case the rest of the second component carrier can be made out of a more rigid material, such as FR4 IT 180A.

An alternative way of providing a flexible and yet electrically conductible connection of the second disc contact to its second component carrier is to use an electrically conducting wire.

With the purpose of optimising the function and working conditions of respective disc contact it is proposed that each surface area and recess of respective counter protrusion is adapted to the size and curvature of the convex disc contact that it is facing.

The invention teaches that each disc contact in a multiple stage switch is adapted to flex into a an electrical connection at a force from the actuator means that is different from the force required to flex any other disc contact in the same multiple stage switch into a an electrical connection, thereby enabling a clear and distinct multiple step tactile feedback to the operator.

The first and respective second component carriers are described as separate component carriers, however, it is also possible that the first and each second component carrier are made out of one flexible component carrier that is folded to form the first and each second component carrier positioned on top of each other.

With the purpose of providing a robust, weatherproof switch assembly that can be adapted to harsh working conditions several measures can be taken and it is proposed that the first and each second component carrier are sealed where possible, that the assembly casing and actuator means are weatherproof, that the assembly casing and actuator means are adapted to requirements for mechanical strength, and/or that the switch assembly is a sealed, weatherproof and EMC certified unit.

Advantages

The advantages that foremost may be associated with a multiple state switch assembly according to the present invention are that the invention provides a compact switch assembly with low building height and a high density of switches on the switch assembly.

The fixed yet flexible positioning of the stacked disc contacts, where no guiding means are required around the disc contact in order to keep them in their positions, and the small but efficient spacing members required to protect the disc contacts from destructive compression enables the compact yet stable multiple stage switches and thus the low building height and high density of switches on the switch assembly.

The compact design is valuable even in a switch assembly with only one multiple stage switch providing space for other components or enabling a very small switch assembly.

One or several controlling members are adapted to the design of the switch assembly and are then inexpensive and easily pre-produced. Every disc contact is mounted to its respective component carrier and the component carriers and required controlling members are easily mounted into a switch assembly. Required disc contacts are mounted to their respective component carriers together with other components belonging to the switch assembly, such pre-produced component carriers together with the pre-produced controlling member(s) provides an inexpensive, time effective and relatively simple production of the switch assembly.

The result of using only a few pre-produced component carriers and controlling members is that both the construction and the production can be made simple, which makes it possible to maintain high production standard and to achieve a high function reliability for the finished product.

The compact design and the use of only a few pre-produced parts makes it possible to provide a sealed and weatherproof unit according to requirements regarding electromagnetic compatibility (EMC) and mechanical strength.

BRIEF DESCRIPTION OF THE DRAWINGS

A multiple state switch assembly according to the present invention will now be described in detail with reference to the accompanying drawings, in which.

DETAILED DESCRIPTION OF PREFERRED EMBODIMENTS

Figure 1:
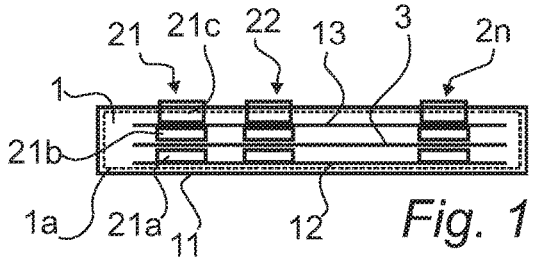
FIG. 1 is a schematic and simplified illustration of an inventive switch assembly.

In the following, the present invention will be described with a reference to FIG. 1 showing an electrical multiple stage switch assembly 1 comprising an assembly casing 11, a first component carrier 12, and at least one multiple stage switch 21, 22, . . . , 2*n*. The invention is not limited to a specific number of switches, the invention can be implemented with only one switch or with several switches depending on application. In the following one multiple stage switch will be described and it should be understood this description is applicable to any one of the multiple stage switches being a part of an inventive multiple stage switch assembly.

Each multiple stage switch 21 comprise a first disc contact 21*a*, at least one second disc contact 21*b*, and an actuator means 21*c*, where respective disc contact is a convex disc contact. The first and second disc contact 21*a*, 21*b* are positioned with their centers substantially aligned. The actuator means 21*c* is positioned in the assembly casing 11 and adapted to compress the first and second disc contact 21*a*, 21*b*.

For the sake of simplicity the invention will be exemplified with only one second disc contact in most of the following detailed description. However, the invention can be implemented with several second disc contacts and in some parts of the description several second disc contacts will be described in order to show specific measures that are taken in order to achieve a multiple stage switch with more than one second disc contact.

The first and second disc contact 21*a*, 21*b* are adapted to flex into an electrical connection when the actuator means 21*c* is pressed and to flex back into a non-electrical connection when the actuator means 21*c* is released.

The first disc contact 21*a* is positioned on the first component carrier 12 in a fixed electrically conductible manner.

FIG. 1 also shows that the switch assembly 1 comprises one second component carrier 13 for each second disc contact and at least one controlling member 3.

Figure 2:
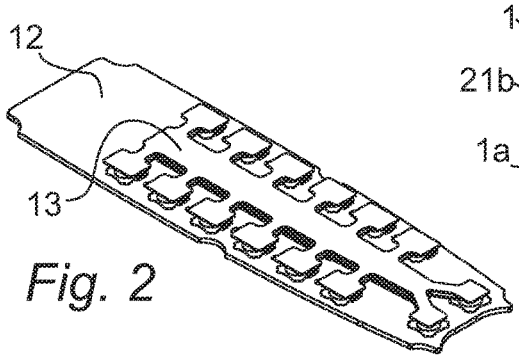
FIG. 2 is a perspective view of a first component carrier, a second component carrier and a controlling member.
Figure 3:
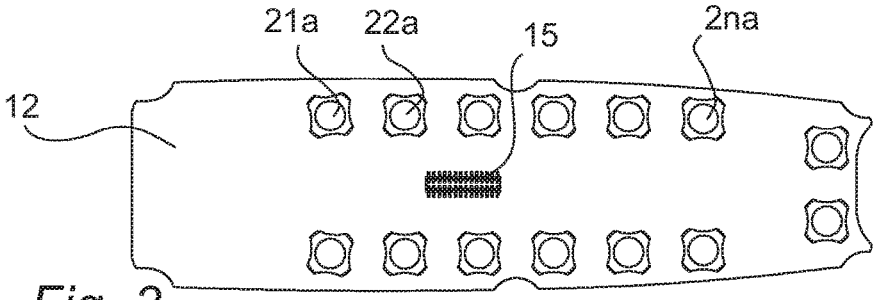
FIG. 3 is a top view of a first component carrier.

FIG. 2 is a more detailed perspective view of one exemplary embodiment of an inventive switch assembly, showing the first and a second carrier 12, 13. FIG. 3 is a top vie of a first carrier 12 with a number of first disc contacts 21*a*, 22*a*, . . . , 2*na*. The first carrier has an electrical contact 15 adapted to provide an electrical connection with the second carrier 13.

Figure 4:
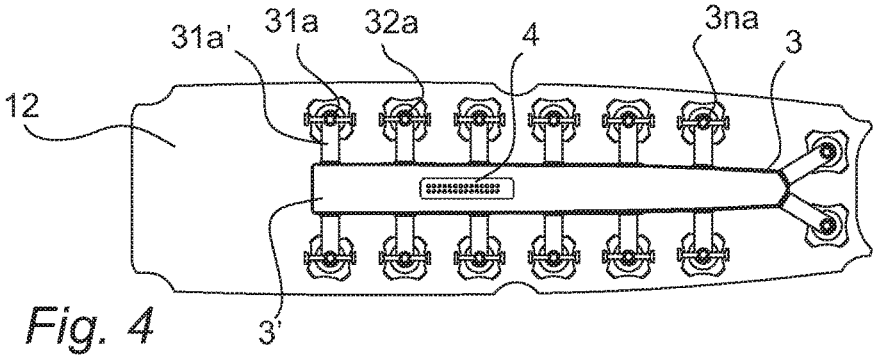
FIG. 4 is a top view of a first component carrier with a controlling member.

FIG. 4 shows the controlling member 3 positioned on the first carrier 12. The controlling member 3 comprises a number of controlling parts 31*a*, 32*a*, . . . , 3*na*, one for each first disc contact 21*a*, 22*a*, . . . , 2*na* and switch.

A controlling member is positioned between the component carriers 12, 13 in a way so that each disc contact 21*a*, 21*b* is facing a controlling part 31*a*.

According to one embodiment it is proposed that the controlling member 3 also has a connection 4 through which the second component carrier 13 can be electrically connected with the electrical contact 15 of the first component carrier 12. The skilled person understands that the connection 4 can be anything that allows an electrical contact between the first and second component carrier 12, 13, such as an opening allowing contact means from the first and second carrier to reach each other or a contact connecting both to a contact on the first component carrier and to a contact on the second component carrier.

It is also possible that an electrical connection between the first and second component carrier 12, 13 is provided outside of the controlling member 3, in which case no connection is required through the controlling member 3.

Figure 5:
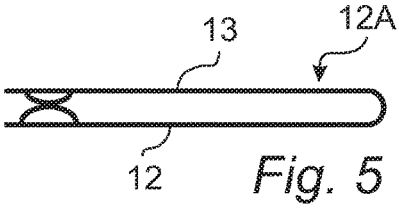
FIG. 5 is a schematic illustration of an embodiment with a flexible component carrier.

Another proposed embodiment, schematically illustrated in FIG. 5, teaches that the first and each second component carrier 12, 13 are made out of one flexible component carrier 12A that is folded to form said first 12 and each second 13 component carrier positioned on top of each other, thereby enabling the required electrical contact between the first component carrier 12 and every second component carrier 13.

Figure 6:
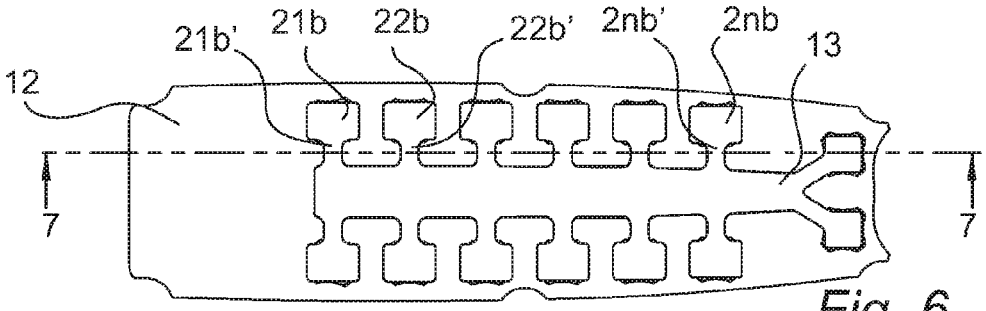
FIG. 6 is a top view of a first component carrier with a second component carrier.

FIG. 6 shows the second component carrier 13 with a number of second disc contacts 21*b*, 22*b*, . . . , 2*nb*, which are connected to the second component carrier 13. When the disc contacts are activated or deactivated there is a movement of the parts in the switch and with the purpose to enable respective second disc contact 21*b*, 22*b*, . . . , 2*nb* to follow the movement of the first and any other second disc contact as the contacts are pressed by the actuator means and as they flex back when released it is proposed that respective second disc contact is connected to its component carrier in a flexible, yet electrically conductible, manner 21*b*', 22*b*', . . . , 2*nb*'.

Figure 7:
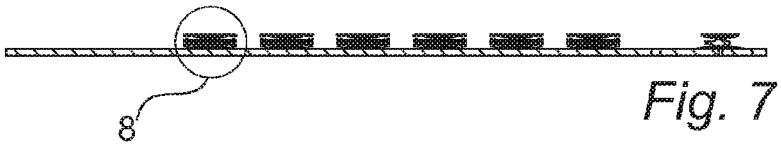
FIG. 7 is a sectional view along line 7-7 of FIG. 6.
Figure 8:
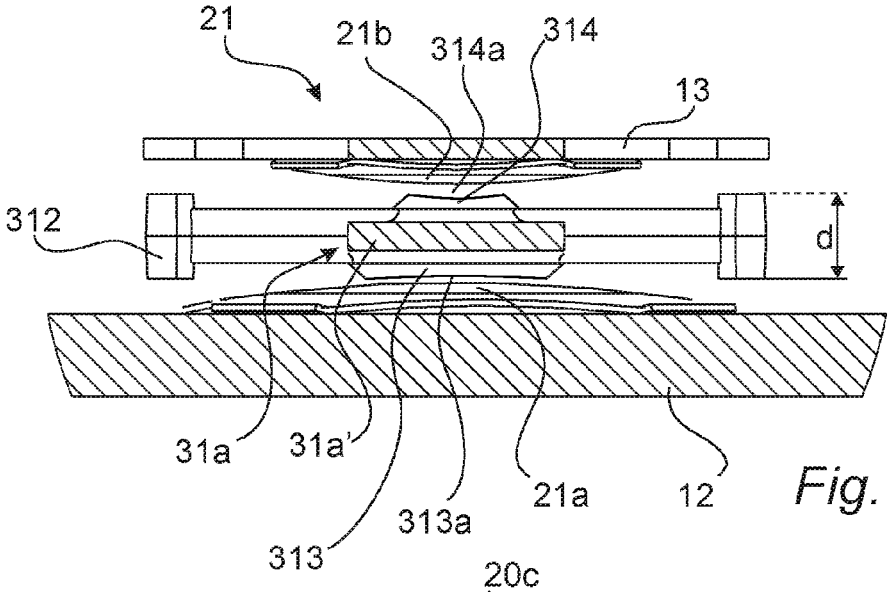
FIG. 8 is a detailed view of the portion identified by circle 8 in FIG. 7, which is a detailed view of a multiple stage switch.

FIG. 7 is a sectional view along line 7-7 of FIG. 6, FIG. 8 is a detailed view of the portion identified by circle 8 in FIG. 7. In this exemplifying embodiment it can be seen that the first disc contact 21*a* is facing the second disc contact 21*b* and that the second disc contact 21*b* is facing the first disc contact 21*a*. The controlling part 31*a* is positioned between the first and second disc contact 21*a*, 21*b* in a way so that each disc contact 21*a*, 21*b* is facing the controlling part 31*a*.

When the disc contacts are activated or deactivated there is a movement of the parts in the switch and in order to enable the controlling part 31*a* to follow the movement of the first and second disc contact 21*a*, 21*b* as the contacts are pressed by the actuator means and as they flex back when released it is proposed that the controlling part 31*a* is connected to the controlling member 3 in a flexible manner, also illustrated in FIG. 4 by the thin flexible connection 31*a*' between the controlling part 31*a* and the body of controlling member 3. It is proposed that the controlling member 3, or at least the flexible connection 31*a*', is made out of a flexible material in order to provide the flexible connection 31*a*' of the controlling part, which has to be a material that can endure the required number of actuations with a maintained mechanical flexibility. An example of a flexible material that can be used is Polyoxymethylene (POM).

The disc contacts 21*a*, 21*b* are specified to manage a number of actuations before wearing out with a specification that is only valid as long as the disc contact is not compressed with a force that would be destructive to the contact. Hence, with the purpose of protecting respective disc contact from destructive compression when pressed by the actuator means, the present invention also teaches that the controlling part 31*a* comprises a spacing member 312 adapted to limit the smallest possible distance d between adjacent component carriers, which in FIG. 8 are the first component carrier 12 and the second component carrier 13. The smallest distance d is set to limit the compression from the actuator means and thereby prevent any destructive pressure on the disc contacts 21*a*, 21*b*.

In an embodiment where adjacent disc contacts are facing each other it is also proposed that the controlling part 31*a* comprises a first counter protrusion 313 facing one disc contact 21*a* and a second counter protrusion 314 facing the other disc contact 21*b*, where respective counter protrusion 313, 314 is recessed 313*a*, 314*a* at the center of the disc for concentrating the applied pressure on the respective disc contact 21*a*, 21*b*, thereby enabling a concentration of the applied pressure to the respective disc contact with its convex shape.

Figure 9:
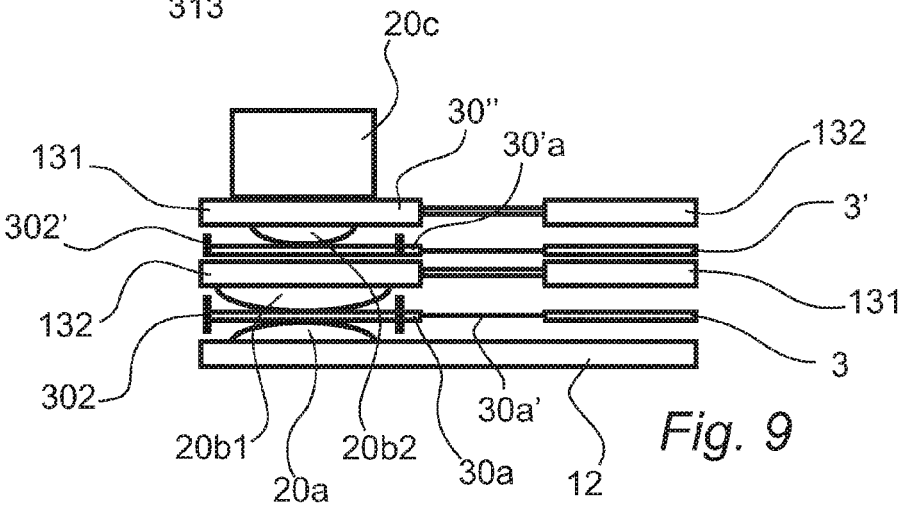
FIG. 9 is a schematic and simplified illustration of a multiple stage switch with three disc contacts.

FIG. 9 shows an example of an embodiment with a multiple stage switch 20 having one first disc contact 20*a*, a first and a second second disc contact 20*b*1, 20*b*2, and an actuator means 20*c*. The first disc contact 20*a* is connected to the first component carrier 12 and each second disc contact 20*b*1, 20*b*2 is connected to its respective second component carriers 131, 132.

In this exemplifying embodiment two controlling members 3, 3' are used, where a first controlling member 3 is positioned so that the first disc contact 20*a* and the first second disc contact 20*b*1 are both facing a controlling part 30*a* belonging to the first controlling member 3. The controlling part 30*a* belonging to the first controlling member 3 comprises a spacing member 302 adapted to limit the smallest possible distance between first component carrier 12 and the first second component carrier 131

A second controlling member 3' is positioned so that the second second disc contact 20*b*2 is facing a controlling part 30'*a* belonging to the second controlling member 3'. The controlling part 30'*a* belonging to the second controlling member 3' comprises a spacing member 302' adapted to limit the smallest possible distance between second second component carrier 132 and the first second component carrier 131.

With renewed reference to FIG. 8 it proposed that the controlling part 31*a* comprises a counter protrusion 313 facing the disc contact 21*a*, which counter protrusion 313 is recessed 131*a* at the center of the disc for concentrating the applied pressure on the disc contact 21*a* with its convex shape.

It is proposed that each second disc contact 21*b*, 22*b*, . . . , 2*nb* is connected to respective second component carrier 13 by means of a connector 21*b*', 22*b*', . . . , 2*nb*' that will allow the required movement of the second disc contact 21*b*, 22*b*, . . . , 2*nb* during the actuation of the contact, where this connector 21*b*', 22*b*', . . . , 2*nb*' is exemplified by a flexible circuit carrier in FIG. 6.

It is important that the second component carrier, or at least the part of the second component carrier that provides the flexibility, the connector 21*b*', 22*b*', . . . , 2*nb*', allows required movement of the second disc contact and can endure the required number of actuations with a maintained electrical conductivity, mechanical strength and flexibility.

An example of a flexible circuit carrier that can be used is PI SF305C 1025. This material can be used for the complete second component carrier 13 or only for the connector 21*b*', 22*b*', . . . , 2*nb*', in which case the rest of the second component carrier 13 could be made out of a more rigid material, such as FR4 IT180A.

The skilled person understand that this flexible electrically conductible connection also can be realised in other ways, such as through an electrically conducting wire.

The present invention teaches that the surface area and recess 313*a*, 314*a* of the respective counter protrusion 313, 314 is adapted to the size and curvature of the disc contact 21*a*, 21*b* that it is facing, thereby optimising the function and working conditions of respective disc contact 21*a*, 21*b*.

With the purpose of providing a clear and distinct multiple step tactile feedback to the operator it is proposed that each disc contact 21*a* in a multiple stage switch is adapted to flex into an electrical connection at a force from the actuator means 21*c* that is different from the force required to flex any other disc contact 21*b* in the same multiple stage switch into an electrical connection.

The invention teaches that one or several of different measures can be taken to reach requirements that can be made on a switch assembly, such as that the first and each second component carrier 12, 13 are sealed where possible, that the assembly casing 11 and actuator means (21*c*) are weatherproof, that the assembly casing 11 and actuator means 21*c* are adapted to requirements for mechanical strength, and that the switch assembly 1 is a sealed 1*a*, weatherproof and EMC certified unit.

It will be understood that the invention is not restricted to the aforedescribed and illustrated exemplifying embodiments thereof and that modifications can be made within the scope of the invention as defined by the accompanying Claims.

The invention claimed is:

1. An electrical multiple stage switch assembly comprising:

an assembly casing;

a first component carrier;

at least one second component carrier;

at least one multiple stage switch, wherein each multiple stage switch comprises:

a first disc contact positioned on the first component carrier;

at least one second disc contact, each of the at least one second component carrier carrying a respective second disc contact, wherein each of the first and the at least one second disc contacts is a convex disc contact; and an actuator; and at least one controlling member, wherein said first and second disc contacts in each multiple stage switch are positioned with their centers substantially aligned, respective actuators are positioned in said assembly casing and adapted to compress said first and second disc contacts, said first and second disc contacts are adapted to flex into an electrical connection when said actuator is pressed and to flex back into a non-electrical connection when said actuator is released, and said first disc contact is positioned on said first component carrier in a fixed electrically conductible manner, and wherein each second component carrier is electrically connected to said first component carrier, each second disc contact is connected to a respective second component carrier in a flexible electrically conductible manner, each controlling member comprises a plurality of controlling parts, one for each switch, each controlling member is positioned between any two adjacent component carriers of said first and second component carriers in a way so that said first disc contact and said at least one second disc contact in each multiple stage switch are facing a respective controlling part, each controlling part comprises a spacing member adapted to limit the smallest possible distance between a respective one of said any two adjacent component carriers, and said smallest possible distance is a distance set to limit the compression from said actuator on said first disc contact and said at least one second disc contact, and wherein the spacing member is arranged radially outside of said first and second disc contacts and is configured to directly contact the said first and second component carriers when the actuator is continuously pressed.

2. The switch assembly according to claim 1, wherein each controlling part comprises a counter protrusion facing a respective disc contact, and said counter protrusion is recessed at the center of the disc for concentrating the applied pressure on said disc contact with its convex shape.

3. The switch assembly according to claim 2, wherein adjacent disc contacts are facing each other, each controlling part comprises a first counter protrusion facing one disc contact and a second counter protrusion facing the other disc contact, and each counter protrusion is recessed at the center of the disc for concentrating the applied pressure on the respective disc contact with its convex shape.

4. The switch assembly according to claim 1, wherein each controlling part is connected to said at least one controlling member in a flexible manner.

5. The switch assembly according to claim 4, wherein Polyoxymethylene (POM) is used as material in said at least one controlling member.

6. The switch assembly according to claim 1, wherein each second disc contact is connected to a respective second component carrier by means of a flexible circuit carrier.

7. The switch assembly according to claim 2, wherein each surface area and recess of a respective counter protrusion is adapted to a size and a curvature of the disc contact that the respective counter protrusion is facing.

8. The switch assembly according to claim 1, wherein each disc contact in a multiple stage switch is adapted to flex into an electrical connection at a force from said actuator that is different from the force required to flex any other disc contact in the same multiple stage switch into an electrical connection.

9. The switch assembly according to claim 1, wherein said first and each second component carrier are made out of one flexible component carrier that is folded to form said first and each second component carrier positioned on top of each other.

10. The switch assembly according to claim 1, wherein said first and each second component carrier are sealed.

11. The switch assembly according to claim 1, wherein said assembly casing and actuator are weatherproof.

12. The switch assembly according to claim 1, wherein said assembly casing and actuator are adapted to requirements for mechanical strength.

13. The switch assembly according to claim 1, wherein said switch assembly is a unit which is sealed and weatherproof.

14. The switch assembly according to claim 2, wherein each controlling part is connected to said at least one controlling member in a flexible manner.

15. The switch assembly according to claim 3, wherein each controlling part is connected to said at least one controlling member in a flexible manner.

16. The switch assembly according to claim 1, wherein the spacing member is formed on a distal end of the controlling part, and prevents, at a time point during pressing the actuator, a further compression from the actuator to said first disc contact and said at least one second disc contact upon a further pressing of the actuator after said time point.

* * * * *